US007967165B2

(12) United States Patent
Nishigaki

(10) Patent No.: US 7,967,165 B2
(45) Date of Patent: Jun. 28, 2011

(54) REINFORCED TRANSPORTATION CONTAINER

(75) Inventor: Masaru Nishigaki, Nagoya (JP)

(73) Assignee: Aiko Co., Ltd., Nagoya-shi, Aichi-ken (JP)

( * ) Notice: Subject to any disclaimer, the term of this patent is extended or adjusted under 35 U.S.C. 154(b) by 69 days.

(21) Appl. No.: 12/069,588

(22) Filed: Feb. 12, 2008

(65) Prior Publication Data

US 2008/0210696 A1 Sep. 4, 2008

Related U.S. Application Data

(63) Continuation of application No. PCT/JP2006/308747, filed on Apr. 26, 2006.

(51) Int. Cl.
*B65D 1/42* (2006.01)

(52) U.S. Cl. ..... 220/646; 220/650

(58) Field of Classification Search ..... 248/510, 248/500, 903, 346.03, 346.04, 346.05; 206/340; 220/642, 646, 647, 650

See application file for complete search history.

(56) References Cited

U.S. PATENT DOCUMENTS

| | | | | |
|---|---|---|---|---|
| 810,574 | A * | 1/1906 | Sewell | 229/117.02 |
| 1,578,557 | A | 5/1926 | Sexton | |
| 1,757,814 | A * | 5/1930 | Quiggin et al. | 206/499 |
| 2,071,663 | A * | 2/1937 | Smith | 292/258 |
| 2,225,592 | A * | 12/1940 | MacFadden | 248/500 |
| 2,230,898 | A * | 2/1941 | MacFadden | 248/500 |
| 2,388,650 | A * | 11/1945 | Whittell et al. | 439/358 |
| 2,656,577 | A * | 10/1953 | Carbary | 248/500 |
| 6,213,005 | B1 * | 4/2001 | Sherman et al. | 99/426 |
| 6,237,803 | B1 * | 5/2001 | Sarnoff et al. | 220/743 |

FOREIGN PATENT DOCUMENTS

| | | | |
|---|---|---|---|
| DE | 9100093 | U | 3/1991 |
| FR | 1546098 | A | 11/1968 |
| FR | 2612493 | A | 9/1988 |
| JP | 50-019804 | U | 3/1975 |
| JP | 59-060127 | U | 4/1984 |
| JP | 2000-226021 | | 8/2000 |

OTHER PUBLICATIONS

International Search Report for PCT/JP2006/308747 dated Aug. 15, 2006.

The extended European search report includes, pursuant to Rule 62 EPC, the supplementary European search report (Art. 153(7) EPC) and the European search opinion.

* cited by examiner

*Primary Examiner* — A. Joseph Wujciak, III

(74) *Attorney, Agent, or Firm* — Yokoi & Co., U.S.A., Inc.; Toshiyuki Yokoi

(57) ABSTRACT

A metal reinforcement fitting 10 including a strip 12 curved vertically upward is attached to a bottom 20*b* of a transportation container 20, and thus upward force can be applied to the bottom 20*b*. The upward force of the metal reinforcement fitting 10 can suppress downward force of a heavy article housed in the transportation container 20. Accordingly, if the metal reinforcement fitting 10 is attached to the bottom 20*b* of the transportation container 20 before the heavy article is housed, the bottom 20*b* can be prevented from bulging. Additionally, even if the bottom 20*b* of the transportation container 20 has already bulged, instability caused by deformation of the bottom 20*b* can be improved by attachment of the metal reinforcement fitting 10. Thus the provided metal reinforcement fitting has durability for long-term use of a transportation container.

6 Claims, 8 Drawing Sheets

REINFORCED TRANSPORTATION CONTAINER

CROSS-REFERENCES TO RELATED APPLICATIONS

This Application is a continuation of the prior International Application No. PCT/JP2006/308747, with an international filing date of Apr. 26, 2006, which designated the United States, the entire disclosures of which Application is expressly incorporated by reference herein.

BACKGROUND OF THE INVENTION (1) Field of the Invention

The present invention relates to a metal reinforcement fitting, more particularly, it relates to a metal reinforcement fitting for transportation containers.

(2) Description of the Related Art

Most transportation containers indispensable to distribution of parts have been conventionally formed of resin. As disclosed in Japanese Published Unexamined Patent Application No. 2000-226021, a plurality of ribs provided on the bottom of such a transportation container allows the container to obtain a high rigidity at the bottom. Additionally, these reinforcing ribs are made thick or cross over each other, and thus the strength of the bottom is increased.

Patent Document 1: Japanese Published Unexamined Patent Application No. 2000-226021

DISCLOSURE OF THE INVENTION

Problems to be Solved by the Invention

However, the bottom of the transportation container made of resin bulges by heat in the case where an article to be housed particularly has heat or a large weight, and the bottom remains in that state even after the article to be housed is taken out.

The thus deformed transportation container is unstable and is a cause of the container falling over during transportation.

Additionally, the thus deformed transportation container cannot be reused, and is disposed and thrown away as industrial waste. This situation goes against the trend of attaching great importance to environmental problems.

BRIEF SUMMARY OF THE INVENTION

The present invention discloses a metal reinforcement fitting which allows a transportation container to have durability for long-term use.

One aspect of the present invention provides a metal reinforcement fitting, which is attached to the bottom of a transportation container formed of resin, including: a pair of hooking parts opposite each other, the hooking parts extending upward in a strip shape along the sides of the transportation container from the bottom side, and each having ends for hooking on a flange formed at the side peripheral edge on the bottom side, the end having a hook-shaped cross section; and a strip which is laid across laterally on the bottom, integrally formed with the pair of hooking parts, and connects the hooking parts to each other.

In the above mentioned invention, the strip equipped with the hooking parts at both ends is attached to the bottom of the transportation container so that the bottom is reinforced.

Here, the transportation container is generally an approximate box-shaped container opened upward. The sides of the opening side of the transportation container have the flange.

Additionally, the flange is provided so that the bottom of the upper transportation container engages with the opening of the lower transportation container in stacking the same kind of transportation containers, the flange projecting outward from the four sides on the bottom side by a predetermined length, and surrounding the peripheral edge.

Here, the hook-shaped portions of the hooking parts hook on the flange formed at the side peripheral edge on the bottom side of the container. The hooking parts are a pair of hooking parts arranged at two sides of the transportation container respectively, the sides being opposite each other. The strip is laid across laterally on the bottom of the transportation container to connect the pair of hooking parts to each other, and attached to the bottom.

The transportation container is formed of resin, and the bottom thereof is softened by thermo-plasticity of the resin when an article to be housed having heat is housed. On the other hand, the metal reinforcement fitting, which includes the hooking parts and the strip, is made of metal, and thus can support the bottom without being softened at the softening temperature of the resin.

Additionally, hereinafter, the length of the strip of the metal reinforcement fitting approximately equals that of the transportation container in a longitudinal direction or short-side direction, and an attachment direction of the metal reinforcement fitting is a direction that the lengths equal each other.

An optional aspect of the present invention provides a metal reinforcement fitting, which is attached to the bottom of the transportation container formed of resin, including: a pair of hooking parts opposite each other, the hooking parts each having ends for hooking on a flange formed on the outer periphery of the opening at the upper part of the transportation container, the end having a hook-shaped cross section; and a strip which is laid laterally along the sides and the bottom of the transportation container, integrally formed with the pair of hooking parts, and connects the hooking parts to each other in an approximate U-shape.

In the above mentioned invention, the approximately U-shaped strip equipped with the hooking parts at both ends is attached to the bottom of the transportation container so that the bottom is reinforced.

Here, the metal reinforcement fitting is attached to the above-described general transportation container having no flange around the sides on the bottom side. The hooking part hook-shaped portions hook on the flange which projects outward from the opening at the upper part by a predetermined length and surrounds the peripheral edge of the opening.

The hooking parts hooked on the flange provided on the peripheral edge of the opening are connected to each other and fixed by the strip in the approximate U-shape along the bottom and both sides of the transportation container. Thus, the bottom of the strip is supported by the hooking parts at both ends via the side parts of the strip.

Another aspect of the present invention provides a metal reinforcement fitting, which is attached to the bottom of the transportation container formed of resin, including: a pair of hooking parts opposite each other, the hooking parts each having screw holes for being connected to the side of the transportation container with screws; and a strip which is laid laterally along the sides and the bottom of the transportation container, integrally formed with the pair of hooking parts, and connects the hooking parts to each other in an approximate U-shape.

In the above mentioned invention, the strip equipped with the hooking parts at both ends is attached to the bottom of the transportation container, the hooking parts having the screw holes, so that the bottom is reinforced.

Here, in order that the bottom is supported by the strip laid across laterally thereon, the pair of hooking parts may be arranged opposite each other at the sides opposite each other of the transportation container so as to fix both sides of the strip to the sides of the container. Accordingly, the hooking parts may be arranged on the upper opening side or on the bottom side of the sides of the transportation container.

However, there is a possibility that unevenness of reinforcement of the bottom is caused unless the strip is evenly fixed to the bottom, and therefore it is preferable that the pair of hooking parts are positioned on the sides at the same height respectively in order to upwardly hook and hold both ends of the strip at an even force.

Accordingly, another aspect of the present invention provides a metal reinforcement fitting which is equipped with the strip formed so as to be curved vertically upward at the center in a length direction.

In the above mentioned invention, the strip abuts against the bottom of the transportation container with the strip curved vertically upward.

Here, both ends of the strip are fixed by the hooking parts provided at both ends with use of a predetermined method. At this time, biasing force is applied vertically upward to the center of the bottom in the length direction of the abutted strip by the curve of the strip attached to the bottom of the transportation container. Therefore, even if an article having a large weight or heat is housed in the transportation container and downward force is applied to the bottom, the downward force is offset by the upward force and the bottom hardly bulges.

Additionally, another aspect of the present invention provides a metal reinforcement fitting which is equipped with ribs formed to be pushed out from a projected side to a recessed side so as to cross over a fold of a bent part, the rib having a crest-shaped cross section.

In the above mentioned invention, the rib, which is pushed out from the projected side to the recessed side so as to cross over the fold of the bent part, is formed at each bent part of the hooking part to reinforce the bent part, the rib having the crest-shaped cross section.

The rib adds thickness to the bent part, and serves as a restriction for preventing surfaces each constituting the bent part from coming into contact with each other in the case where force is applied to the surfaces in a bend direction.

Additionally, another aspect of the present invention provides a metal reinforcement fitting which is equipped with the strip which is bent or curved in the length direction to be formed as a non-flat plate.

In the above mentioned invention, the strip is formed as a non-flat plate having a part bent into a predetermined shape in the length direction.

Here, the part bent into the predetermined shape in the length direction is formed in the strip, and thus the cross section of the bent part of the strip in a width direction becomes uneven. Accordingly, bending rigidity of the strip is increased by the unevenness in the cross section. That is, the strip is hardly deformed against external force by forming into the non-flat plate.

Here, the cross section may become uneven so that the strip becomes the non-flat plate.

As an example of non-flat plates having unevenness, ends of the strip in the width direction are bent, and the strip is formed in an approximate U-shape.

In the above mentioned invention, both ends of the strip in the width direction are bent so that the strip is formed as a non-flat plate.

Similarly, as an example of non-flat plates, the strip has a ridge extended in the length direction.

In the above mentioned invention, the strip includes the ridge-shaped extending part having a predetermined width in the length direction. The ridge is obtained in a manner that a half arc-shaped recess having a predetermined width is formed in the both sides direction about the center of the strip in the length direction, and thus the strip becomes a non-flat plate.

Here, the strip includes the unevenness thereon so that force is evenly dispersed, and thus may become a non-flat plate. Accordingly, the width of the ridge is arbitrary relative to the center in the width direction. Additionally, two ridges having the same length may be juxtaposed so as to be symmetrical relative to the center of the strip in the width direction.

Here, another aspect of the present invention provides a metal reinforcement fitting which is equipped with the strip which is thermal-treated and formed so as to have resilience so that the vertical upward biasing force is applied to the bottom when the strip is attached to the transportation container.

In the above mentioned invention, the hardness of the strip is freely adjusted by thermal treatment so that the strip has resilience.

Further, a metal reinforcement fitting including the strip can be made of special steel that the strength and toughness are raised by adding a predetermined alloy to iron. In this case, the strip is formed of the special steel and subjected to thermal treatment, the hardness is freely adjusted, and thus high resilience is applied to the strip.

Additionally, another aspect of the present invention provides a metal reinforcement fitting where the plurality of metal reinforcement fittings can be attached, parallel with each other at a predetermined spacing, to the bottom of the transportation container.

In the above mentioned invention, the plurality of strips are attached to the bottom of the transportation container so as to be parallel with each other.

Here, the strips may arbitrarily reinforce a desired position or wide range of the bottom, and the metal reinforcement fittings having the same attachment direction may be attached to the desired position. The metal reinforcement fittings may be attached to a plurality of desired positions of the bottom respectively, or may be attached so as to press a bulged position in a wide range of the bottom.

As described above, the bottom of a transportation container can be pushed up and reinforced.

Further, the bottom of the transportation container is pushed up by resilience of a strip, and the periphery of the strip can be prevented from bulging. Additionally, the shape of the deformed bottom can be improved by attaching a metal reinforcement fitting of the invention to the bottom.

Further, a hooking part of a metal reinforcement fitting can be prevented from being folded at each bent part.

Further, bending rigidity of the strip can be raised.

Further, upward force can be applied to the bottom of the transportation container abutted against the strip.

Further, bulge of the bottom of the transportation container can be widely prevented or improved.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding parts throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

A preferred embodiment of the present invention will be described below in the below mentioned order:

(1) Embodiment;

(2) Modification; and (3) Conclusion (1) Embodiment

Figure 1:
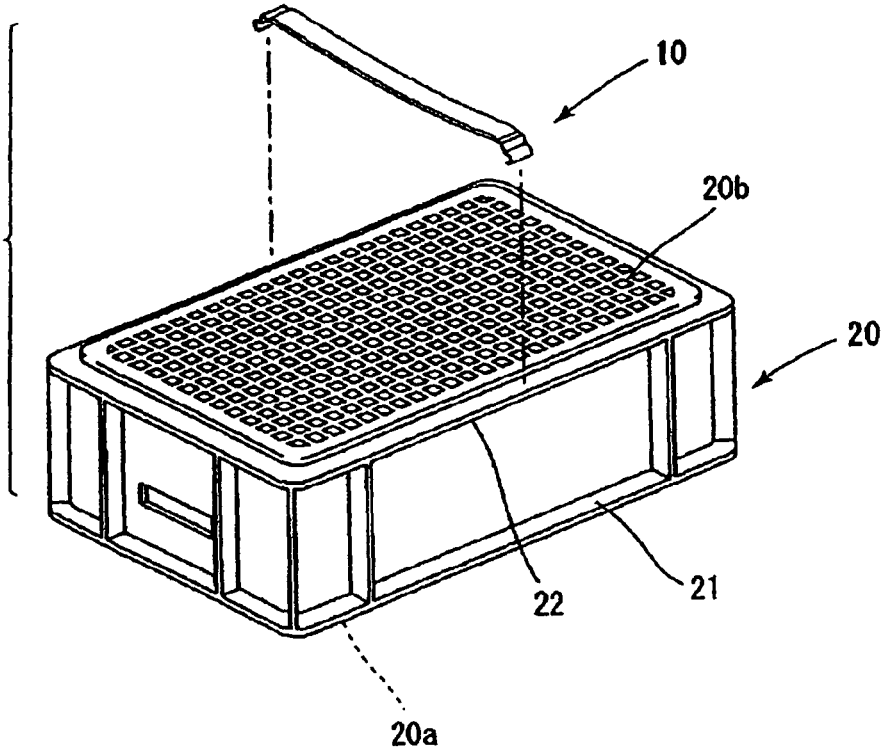
FIG. 1 is an exemplary illustration of a perspective bottom-side view of a metal reinforcement fitting and transportation container.

FIG. 1 is a perspective bottom-side view of a metal reinforcement fitting 10 and transportation container 20.

As shown in FIG. 1, the transportation container 20 formed of resin is in an approximate box shape that the upper side is opened, and the metal reinforcement fitting 10 according to the present invention is attached from underneath to the bottom of the transportation container 20.

An upper side flange 21 is provided on the sides of the upper side of the transportation container 20, the flange 21 projecting outward continuously from an opening 20*a*, and from the sides by a predetermined length, and surrounding the peripheral edge of the opening 20*a*. Additionally, the sides of the bottom side of the transportation container 20 have a bottom side flange 22, the flange 22 projecting outward by the same length as that of the upper side flange 21, and surrounding the peripheral edge. Thus, in stacking the same kind of transportation containers 20, the sides and the bottom 20*b* lower than the bottom side flange 22 of the upper transportation container 20 are inserted into the opening 20*a* of the upper side of the lower transportation container 20, the sides and the bottom being lower than the bottom side flange 22. Then, the transportation containers 20 are stacked in a manner that the upper surface of the upper side flange 21 continuous with the opening 20*a* abuts with the lower surface of the bottom side flange 22.

Figure 2:
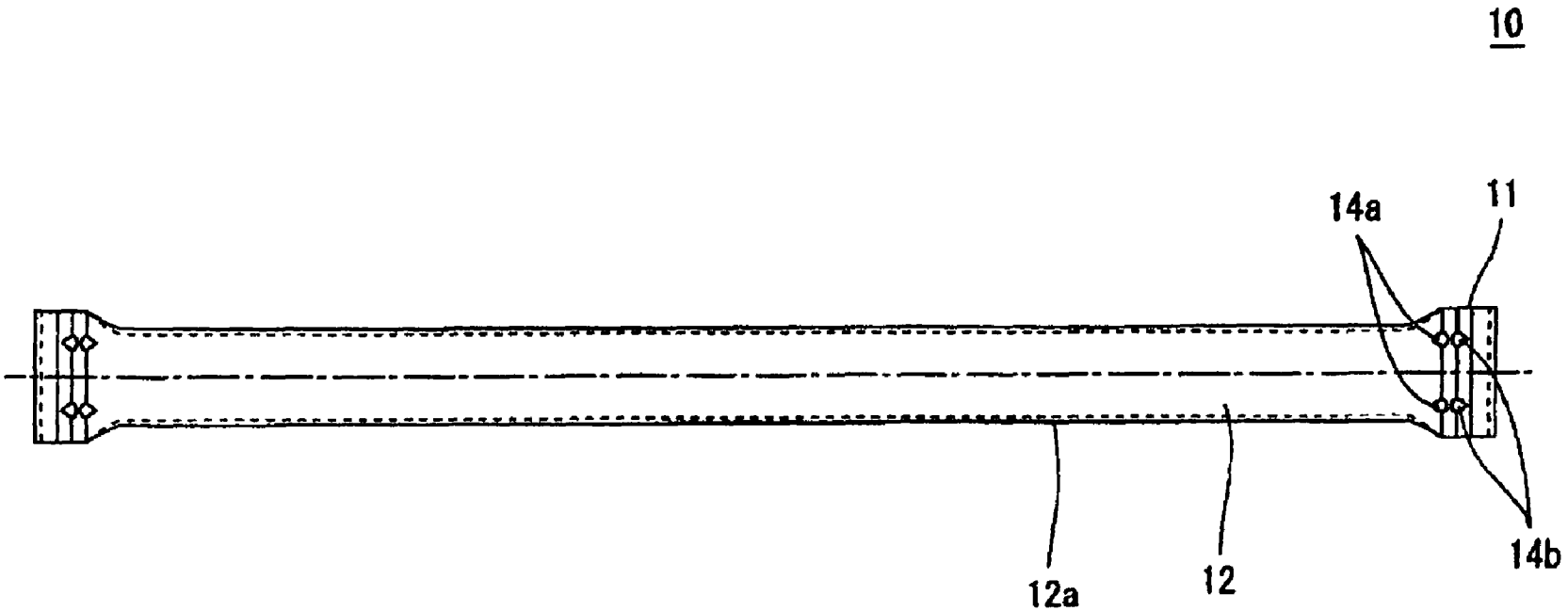
FIG. 2 is an exemplary illustration of a schematic top plan view of the metal reinforcement fitting.
Figure 3:
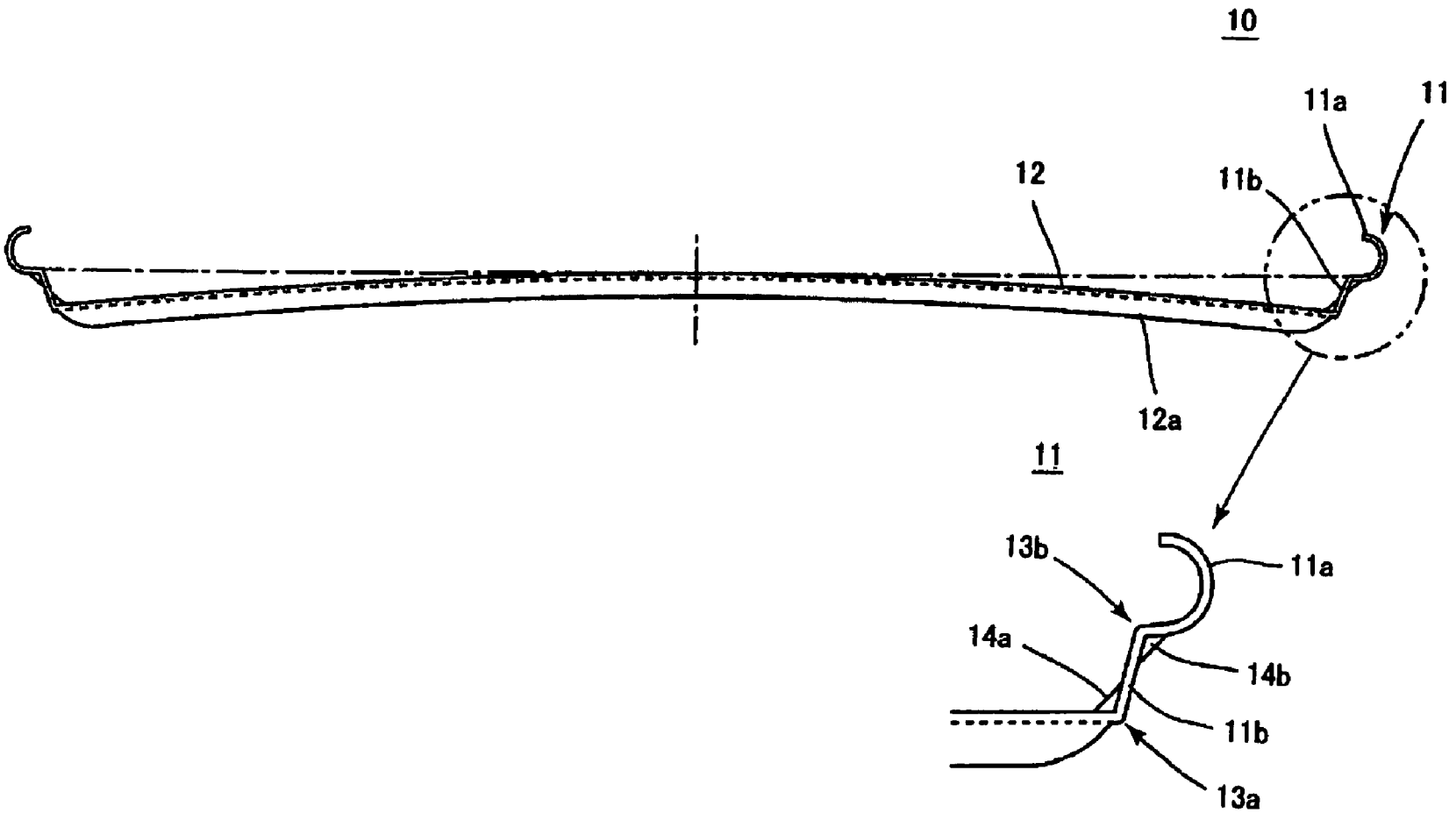
FIG. 3 is an exemplary illustration of a schematic side view of the metal reinforcement fitting.

The metal reinforcement fitting 10 is formed of special steel having a strong resilience by thermal treatment, and, as shown in FIG. 2 and FIG. 3, includes a pair of hooking parts 11 and a strip 12 for connecting the hooking parts 11 to each other at the same width.

The strip 12 has a predetermined width, and the length of the strip 12 approximately equals that of the transportation container 20 in a short-side direction. Both left and right ends of the strip 12 in a length direction are bent so as to extend approximately vertically upward, first bent parts 13*a* are formed, and hooking bases 11*b* of the hooking parts 11 are formed.

Further, second bent parts 13*b* are formed at both left and right ends directed upward of the hooking bases 11*b*, the second bent part 13*b* being approximately orthogonal to an outward direction of the strip 12 in the length direction. The hooking base 11*b* is connected, via the second bent part 13*b*, to a hook-shaped portion 11*a* an end of which is directed to the inner side of the strip 12 and which has a semicircular cross section.

As described above, the metal reinforcement fitting 10 has a shape that the strip 12 connects the hooking parts 11 to each other at both ends via the first bent parts 13*a*, the hooking parts 11 being arranged at both left and right ends of the strip 12 respectively with the hooking sides of the hook-shaped portions 11*a* opposite each other.

In the hooking part 11, reinforcing parts 14*a* and 14*b* are formed at positions, which are symmetrical to each other in the width direction, of first bent part 13*a* and second bent part 13*b*, respectively. The reinforcing parts 14*a* and 14*b* each have a rib which is pushed out from the projected side to the recessed side so as to cross over the fold of the bent part, and the rib has a crest-shaped cross section.

The reinforcing parts 14*a* and 14*b* are in the rib shape, and serve as a restriction for preventing surfaces each constituting the bent part from coming into contact with each other by adding thickness to a part of the first bent part 13*a* and a part of the second bent part 13*b* and filling in the bending angles in the case where force is applied to the surfaces in a bend direction.

Accordingly, the reinforcing parts 14*a* and 14*b* prevent each bent part from being folded in the case where the force is applied to the first bent part 13*a* and second bent part 13*b*.

As described above, the strip 12 connects the pair of hooking parts 11 to each other via the bent parts and curves vertically upward at the center in the length direction. In the embodiment, the height of the center is the same as that of the second bent part 13*b* between the hook-shaped portion 11*a* and the hooking base 11*b*. Additionally, the strip 12 is formed in an approximate U-shape in a manner that both ends 12*a* in the width direction are bent downward at right angles by one-sixth of the whole width, respectively.

Unevenness is thus formed on the cross section of the strip 12 in the width direction, the strip is made as a non-flat plate, and thus bending rigidity of the strip 12 is increased, and the strip is reinforced so as to be hardly deformed even if external force is applied thereto.

Figure 4:
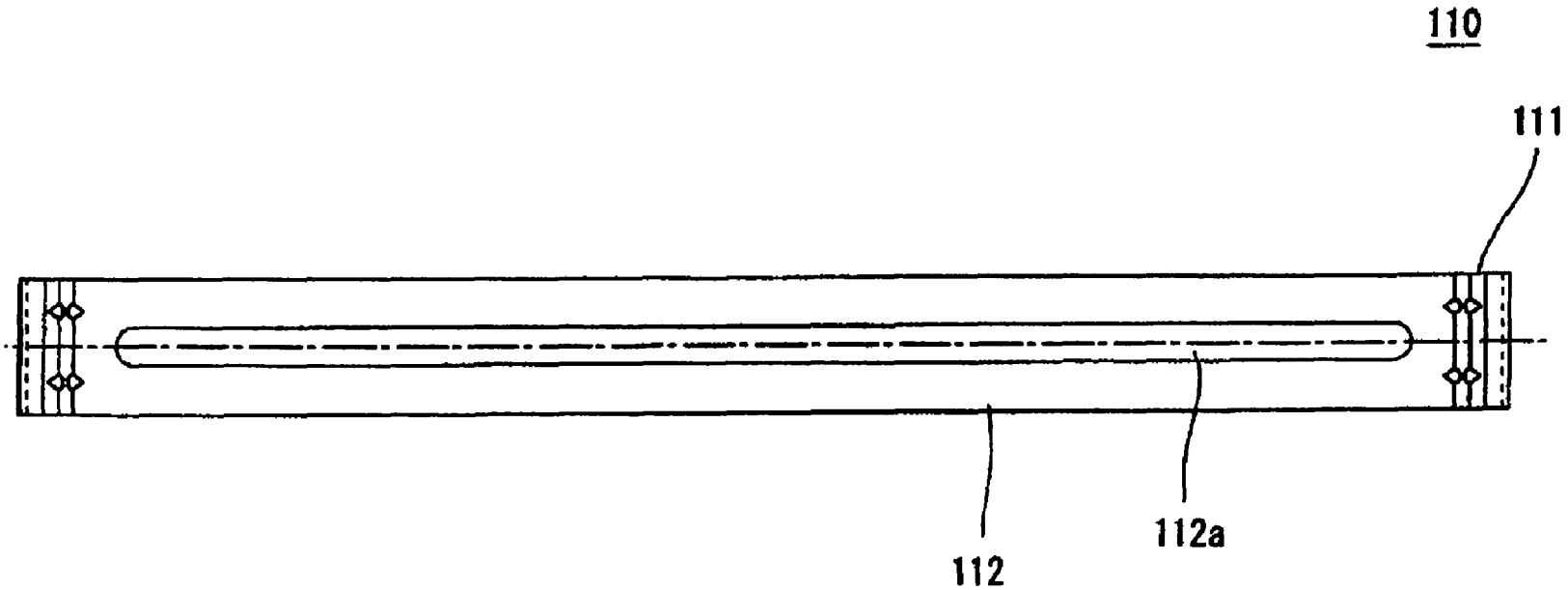
FIG. 4 is an exemplary illustration of a schematic top plan view of the metal reinforcement fitting according to a modification.
Figure 5:
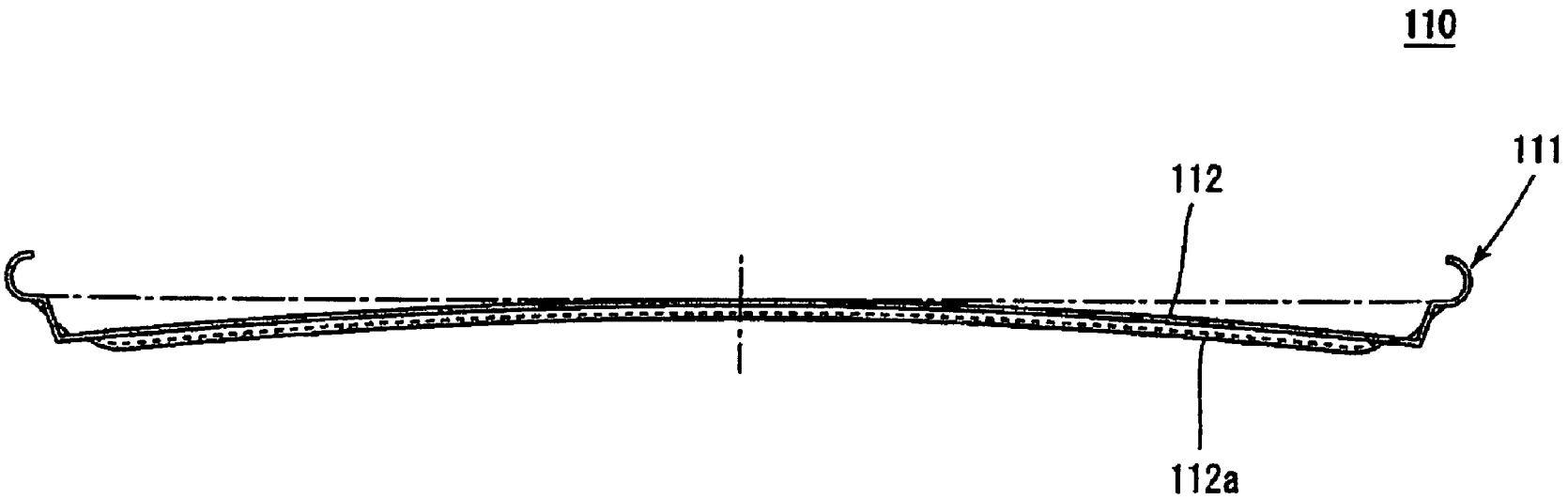
FIG. 5 is an exemplary illustration of a schematic side view of the metal reinforcement fitting according to a modification.

Additionally, as a modification of the unevenness of the cross section of the strip 12, a metal reinforcement fitting 110 is shown in FIG. 4 and FIG. 5. As shown in FIG. 4 and FIG. 5, a half arc-shaped recess, a ridge-shaped extending part

112*a*, can be formed in a strip 112 in the length direction, the recess being symmetrical relative to the center of the strip 112 and having a width of one-third of the whole width in the both sides direction.

Next, an attaching method of the metal reinforcement fitting 10 to the transportation container 20 will be described.

Figure 6:
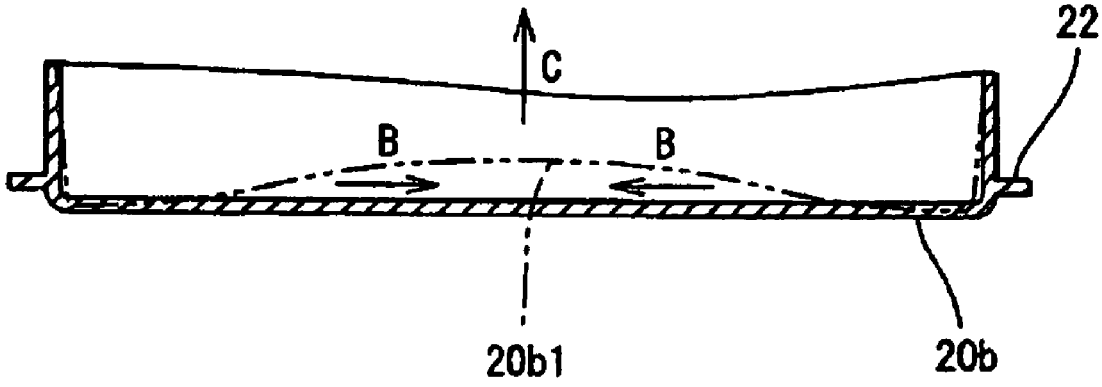
FIG. 6 is an exemplary illustration of a schematic cross sectional view showing a bend direction of the bottom side of the transportation container.

FIG. 6 shows a schematic cross sectional view of the bottom side of the transportation container 20 in the short-side direction.

A bottom 20*b* of the transportation container 20 is first pushed toward the opening 20*a* as indicated by an arrow C in FIG. 6. Then, the bottom 20*b* is bent toward the inner side (arrow B in FIG. 6) of the transportation container 20 in the short-side direction, becomes bow-shaped like a bottom 20*b*1 indicated by a broken line in FIG. 6, and the width of the bottom 20*b*1 becomes narrower than that of the bottom 20*b* before being pushed.

Here, the length of the strip 12 of the metal reinforcement fitting 10 to be attached to the bottom 20*b* approximately equals that of the transportation container 20 in the short-side direction, and the width of the bow-shaped bottom 20*b*1 becomes narrower than the length of the strip.

Thereupon, the hooking parts 11 of the metal reinforcement fitting 10 are directed to the bottom 20*b*1 side, and one of the hooking parts 11 is hooked on one side of the bottom side flange 22. Here, since the width of the bottom 20*b*1 is narrower than the length of the strip, the metal reinforcement fitting 10 can be laid across the bow-shaped bottom 20*b*1 with one of the hooking parts hooked.

When the pressing force to the bottom 20*b*1 is stopped with the metal reinforcement fitting 10 thus laid across the bottom 20*b*1, the bow-shaped bottom 20*b*1 returns to its original flat state, and simultaneously the side, on which the hooking part is not hooked, of the bottom side flange 22 is inserted into another hooking part 11 not hooking on the bottom flange.

Figure 7:
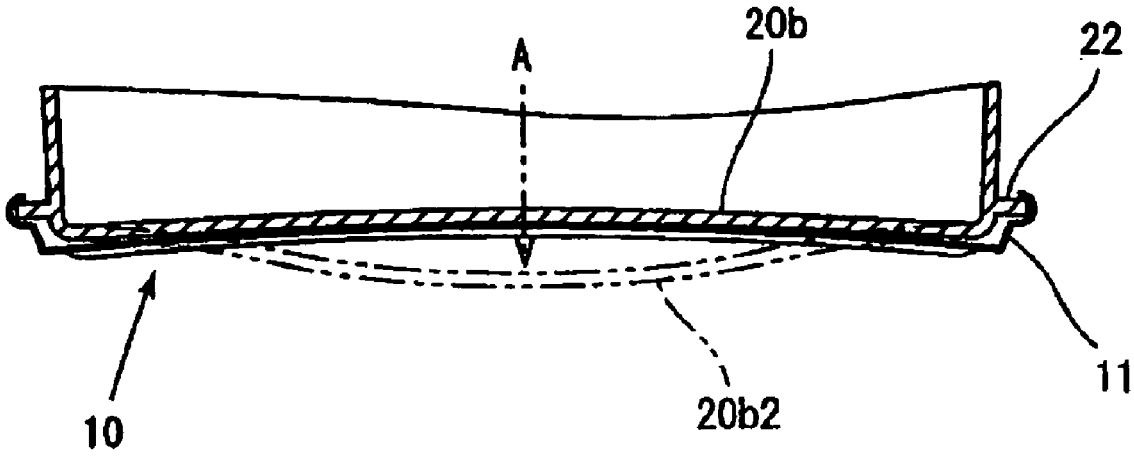
FIG. 7 is an exemplary illustration of a schematic cross sectional view showing a state where the metal reinforcement fitting is attached to the transportation container.

As described above, the metal reinforcement fitting 10 is attached to the bottom 20*b* as shown in FIG. 7.

FIG. 7 is a schematic cross sectional view of the metal reinforcement fitting 10 attached to the bottom 20*b* of the transportation container 20.

In FIG. 7, a bottom 20*b*2 in the case where a heavy article or the like is housed in the transportation container 20 is shown by a broken line.

The transportation container 20 has thermo-plasticity because of being made of resin, and is softened by weight or heat of an article to be housed and easily deformed. In particular, downward force is applied to the bottom 20*b*, which frequently supports the weight of the heavy article with one surface, by the weight or heat of the article to be housed as indicated by an arrow A in FIG. 7, and the bottom 20*b* bulges like the bottom 20*b*2.

However, the metal reinforcement fitting 10 to be attached to the bottom 20*b* is made of special steel, and therefore can support the bottom 20*b* without being softened at the softening temperature of resin.

Additionally, the weight of the article to be housed is rarely applied to a side 20*c* of the transportation container 20, and the bottom side flange 22 formed on the sides 20*c* is hardly affected by the weight or heat of the article to be housed. Accordingly, the hooking parts 11, which are hooked over the bottom side flange 22, are not made unstable by the weight and heat of the article to be housed, and the strip of the metal reinforcement fitting 10 can support the bottom.

Further, since the strip 12 is curved vertically upward and abuts against the bottom 20*b*, the bottom 20*b* is pushed upward as indicated by the arrow C in FIG. 7.

Accordingly, the downward force to the bottom 20*b* can be suppressed by attachment of the metal reinforcement fitting 10.

As described above, upward force can be applied to the bottom 20*b* of the transportation container 20 by the attachment of the metal reinforcement fitting 10. The upward force of the metal reinforcement fitting 10 can suppress the downward force of the heavy article housed in the transportation container 20. Accordingly, if the metal reinforcement fitting is attached to the bottom 20*b* of the transportation container 20 before the article to be housed is housed, the bottom 20*b* is prevented from bulging. Additionally, even if the bottom 20*b* of the transportation container 20 has already bulged, instability caused by deformation of the bottom 20*b* can be improved by the attachment of the metal reinforcement fitting 10.

Figure 8:
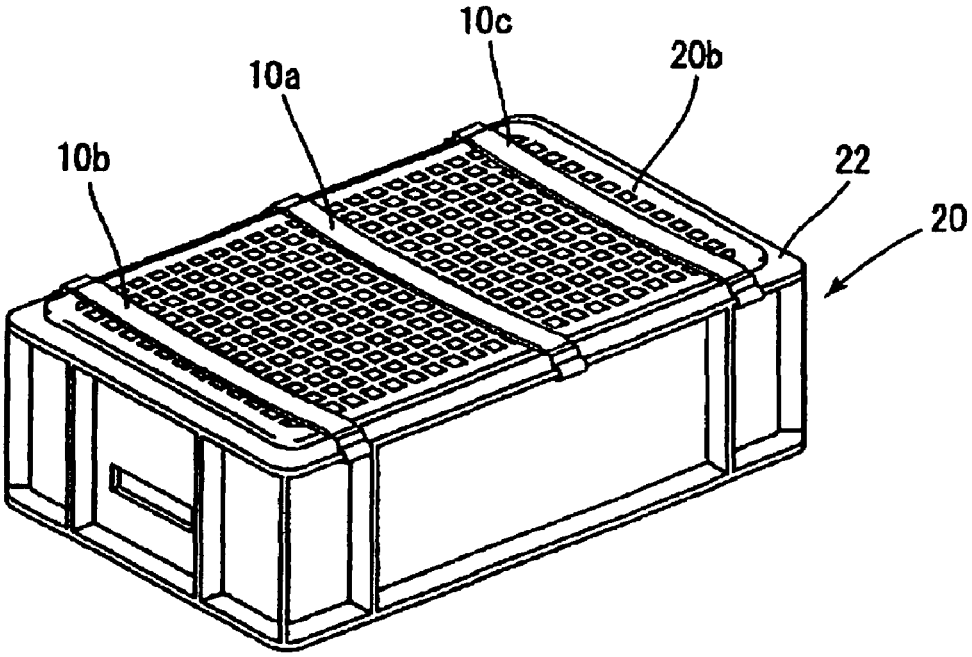
FIG. 8 is an exemplary illustration of a schematic perspective bottom-side view of the transportation container to which the plurality of metal reinforcement fittings are attached.

Here, as shown in FIG. 8, the plurality of metal reinforcement fittings 10 described in the above embodiment can be attached to the bottom 20*b* of the transportation container 20.

In FIG. 8, each length of metal reinforcement fittings 10*a*, 10*b* and 10*c* approximately equals that of the transportation container 20 in the short-side direction. The metal reinforcement fitting 10*a* is attached to the center of the bottom 20*b* in a longitudinal direction so as to be orthogonal to the longitudinal direction, and the metal reinforcement fittings 10*b* and 10*c* are parallel with the metal reinforcement fitting 10*a*, the fitting 10*a* being put between the fittings 10*b* and 10*c*, and are attached to the end sides of the bottom 20*b* in the longitudinal direction, respectively.

The bottom 20*b* can be supported by the plurality of metal reinforcement fittings thus arranged. The case is described here where the three metal reinforcement fittings 10 are attached. However, the number of metal reinforcement fittings can be arbitrarily selected in accordance with the shape of the article to be housed in the transportation container 20.

For example, in the case where the weight of the article to be housed is applied to only a specific portion of the bottom 20*b*, if the metal reinforcement fittings 10 are attached to the corresponding positions of the bottom 20*b* respectively, the corresponding positions are prevented from bulging and the bottom 20*b* can be kept well-balanced.

Additionally, in the case where the transportation container 20 is large and single metal reinforcement fittings 10 cannot prevent the bottom 20*b* from bulging, the bulge is suppressed in the wide range of the bottom 20*b* by evenly attaching the plurality of metal reinforcement fittings 10 to the bottom.

Further, the case will be described where the metal reinforcement fittings 10 cross each other and are attached to the bottom 20*b* of the transportation container 20. A first metal reinforcement fitting 30 and second metal reinforcement fitting 40 (both not shown) are used, the fitting 30 having a length the same as that of the bottom 20*b* in the short-side direction, and the fitting 40 having a length the same as that of the bottom 20*b* in the longitudinal direction. The first metal reinforcement fitting 30 is first arranged, in the short-side direction, at the center of the bottom 20*b* in the longitudinal direction. Then, hooking parts 31 of the first metal reinforcement fitting 30 are hooked on the bottom side flange 22 formed on the sides 20*c* of the bottom 20*b* in the longitudinal direction.

On the other hand, the second metal reinforcement fitting 40 is arranged at a position, which strips 32 and 42 cross each other, at the bottom 20*b* so as to be approximately orthogonal to the first metal reinforcement fitting 30 at both centers of the fittings in the longitudinal direction. Hooking parts 41 of the second metal reinforcement fitting 40 are hooked on the bottom side flange 22 formed on the sides 20*c* of the bottom 20*b* in the short-side direction, and thus attaching the two metal reinforcement fittings 30 and 40 to the bottom 20*b* is completed.

Here, in the first metal reinforcement fitting 30, both ends 32*a*, which are bent downward at right angles, of the strip 32 in the width direction are made approximately recess-shaped at the part on which the strips 32 and 42 cross each other, at the width of the strip 42 in the length direction.

Then, when the first metal reinforcement fitting 30 and the second metal reinforcement fitting 40 cross, both ends 42*a*, which are similarly bent downward at right angles, of the strip 42 in the width direction are equivalent with both approximate recess-shaped ends 32*a*, and movement of the strip 42 of the second metal reinforcement fitting 40 in the width direction can be restricted.

Additionally, the approximate recess may be provided at either both ends 32*a* or both ends 42*a*, or at both ends 32*a* and both ends 42*a*, depending on the attachment order of the metal reinforcement fittings 30 and 40 to the bottom 20*b*.

As described above, the metal reinforcement fittings 10 are attached to the bottom 20*b* in an approximate cross shape to reinforce the bottom 20*b*, and thus the bottom 20*b* can be prevented from bulging.

Similarly, the case will be described where the metal reinforcement fittings 10 cross each other and are attached to the bottom 20*b* of the transportation container 20.

Here, third metal reinforcement fitting 50 and fourth metal reinforcement fitting 60 are used, the fittings having the same shape, and each having a length the same as that of the diagonal of the bottom 20*b*. Both ends of the third metal reinforcement fitting 50 are forked, and two legs of the fork are branched at the position one-eighth of the third metal reinforcement fitting 50 from the end, and have the same width in the width direction. The two legs of the fork 52*b* extend left at 45□ and right at 45□ in the length direction of the third metal reinforcement fitting 50 respectively, and a hooking part 51 is provided at each top end, the hooking part 51 having the same shape as that of the hooking part 11 shown in FIG. 3. Forks 62*b* and hooking parts 61, which are formed at both ends of the fourth metal reinforcement fitting 40, are similar to the forks 52*b* and the hooking parts 51, respectively.

Here, an attachment method of the third metal reinforcement fitting 50 and fourth metal reinforcement fitting 60 to the bottom 20*b* will be described.

First, the third metal reinforcement fitting 50 is arranged on the diagonal of the bottom 20*b*. Then, the two legs of each fork 52*b* at both ends of the third metal reinforcement fitting 50 are opened from each other at right angles with respect to the corner of the bottom 20*b* on which the third metal reinforcement fitting 50 is arranged.

Further, the right leg of the fork 52*b* of the end of the third metal reinforcement fitting 50 is approximately orthogonal to the side 20*c* of the bottom 20*b* in the longitudinal direction, and the hooking part 51 formed at the top end of the right leg can be hooked on the bottom side flange 22 formed on the bottom side. Additionally, the left leg of the fork 52*b* of both ends of the third metal reinforcement fitting 50 is approximately orthogonal to the side 20*c* of the bottom 20*b* in the short-side direction, and the hooking part 51 formed at the top end of the left leg can be hooked on the bottom side flange 22 formed on the side 20*c* of the bottom 20*b* in the short-side direction.

Each hooking part 51 is thus hooked on the bottom side flange 22, and the third metal reinforcement fitting 50 is fixed to the bottom 20.

On the other hand, the fourth metal reinforcement fitting 60 is arranged on the diagonal formed with respect to the corners relative to the corners of the bottom 20*b* on which the third metal reinforcement fitting 50 is arranged, and the hooking parts 61 are hooked on the bottom side flange 22 formed on sides 20*c*, similar to the third metal reinforcement fitting 50, so that the fourth metal reinforcement fitting 60 is fixed to the bottom 20*b*.

As described above, the third metal reinforcement fitting 50 and the fourth metal reinforcement fitting 60 cross each center in the length direction, form an approximate X-shape on the bottom 20*b*, and can reinforce the bottom 20*b*.

Even with this embodiment, both ends 52*a* and 62*a* of the strips 52 and 62 of the third metal reinforcement fitting 50 and fourth metal reinforcement fitting 60 crossing each other in the width direction may be formed in the above-described approximate recess shape.

Additionally, shapes of the hooking parts 51 and 61 may be arbitrarily selected as long as the hooking parts 51 and 61 can be hooked on the corners constituted by the two sides 20*c*, which are continuous and approximately orthogonal to each other, and the bottom 20*b* of the transportation container 20.

Although the case is described above where the two metal reinforcement fittings 10 are attached to and reinforce the bottom 20*b* in the approximate cross shape or approximate X-shape, the two metal reinforcement fittings 10 may be a four-pronged fork-shaped metal reinforcement fitting in which the strips 11 of the two metal reinforcement fittings 10 are integrally connected to each other.

(2) Modification

Figure 9:
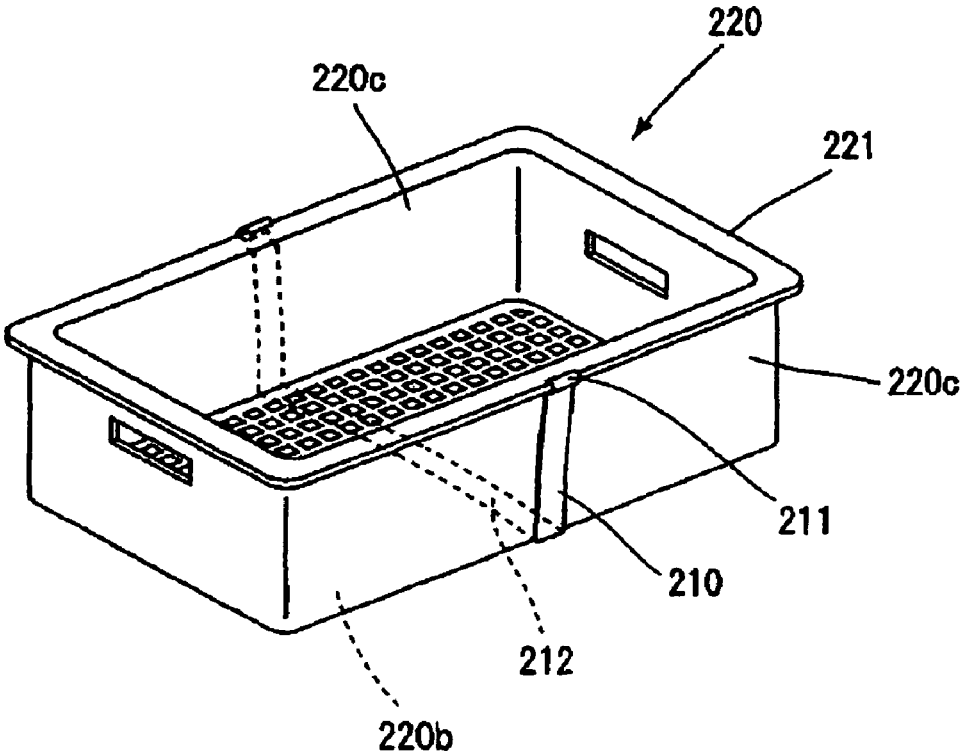
FIG. 9 is an exemplary illustration of a schematic perspective top-side view of the transportation container to which the metal reinforcement fitting according to a modification is attached.

FIG. 9 is a schematic perspective view of a transportation container 220 to which a metal reinforcement fitting 210 according to a modification is attached.

In FIG. 9, the transportation container 220 includes an upper side flange 221, but includes no bottom side flange. Since hooking parts 211 cannot be hooked on the sides of the bottom side of the transportation container 220, the hooking parts 211 of the metal reinforcement fitting 210 are hooked on the upper side flange 221 in this modification. Then, a strip 212 of the metal reinforcement fitting 210 is formed so as to connect the hooking parts 211 to each other via both sides 220*c* from a bottom 220*b* of the transportation container 220.

Here, a hook-shaped portion 211*a* and a hooking base 211*b* of the hooking part 211 are formed along the upper side flange 221, and the strip 212 is formed along the sides 220*c* under the hooking base 211.

The strip 212 on the bottom 220*b* is, similar to the above embodiment, formed in an approximate U-shape by bending the ends in the width direction, made as a non-flat plate, has a raised strength, and is curved vertically upward. Then, the hooking parts 211 are hooked at both ends, and thus both ends are lifted up from the bottom 220*b* via the strip 212 positioned on the sides 220*c*, and the strip 212 is closely fixed to the bottom 220*b*. Then, similar to the above embodiment, the resilience of the strip 212 and the hooking parts 211 positioned at both ends acts on the bottom side of the transportation container 220. Thus, downward force of the heavy article housed in the transportation container 220 to the bottom 220*b* can be suppressed.

As described above, even in the case where the transportation container 220 has no bottom side flange, the metal reinforcement fitting 210 can be attached, and the bottom 220*b* can be prevented from being deformed.

Next, examples will be described where a metal reinforcement fitting 310 is, for attachment thereof, hooked on sides 320*c* at the bottom side of a transportation container 320 having no proper part for holding a hook.

Figure 10:
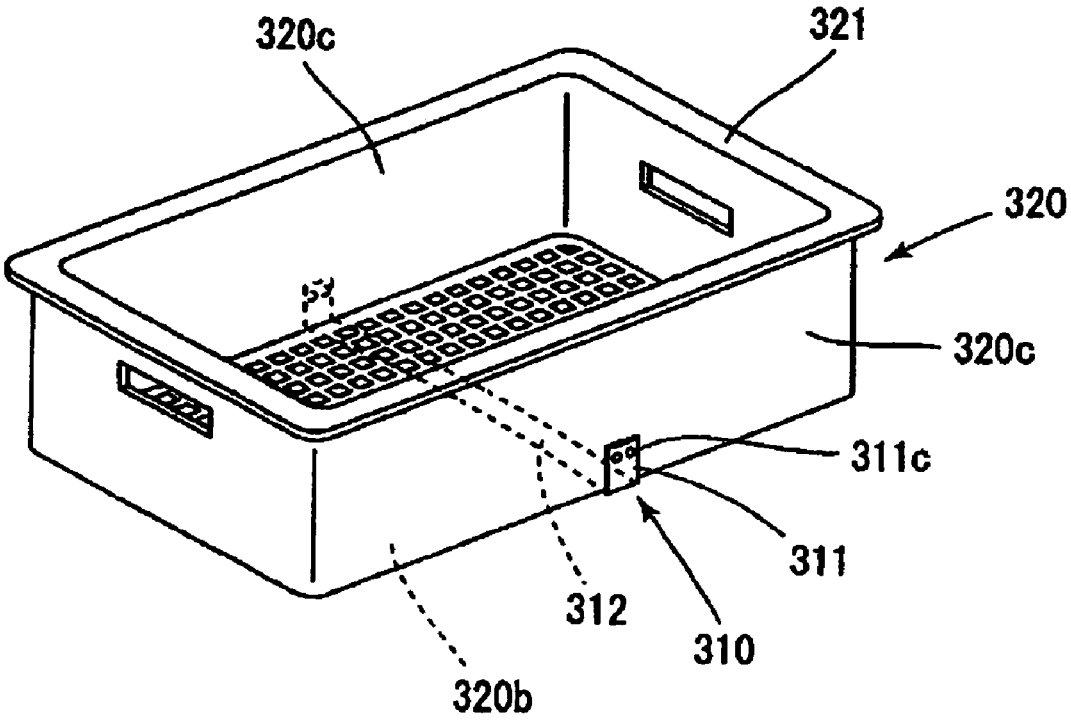
FIG. 10 is an exemplary illustration of a schematic perspective top-side view of the transportation container to which the metal reinforcement fitting according to a modification is attached.

FIG. 10 is a schematic perspective view of the transportation container 320 to which the metal reinforcement fitting 310 according to the modification is attached.

In FIG. 10, similar to the above modification, the transportation container 320 has no bottom side flange. Here, screw holes 311*c* are provided in the end of a hooking part 311 of the metal reinforcement fitting 310. Additionally, screw holes (not shown) are provided at the position, which corresponds to the screw holes 311*c* when the metal reinforcement fitting 310 is attached, of the transportation container 320. Screws engage with the screw holes, and thus the container 320 and fitting 310 are fixed to each other.

A strip 312 on a bottom 320*b* is, similar to the above embodiment, formed in an approximate U-shape by bending the ends in the width direction, made as a non-flat plate, has a raised strength, and is curved vertically upward. Then, both ends of the strip 312 are fixed by screw engagement of the hooking parts 311 and the sides 320*c* of the transportation container 320, and thus both ends are lifted up from the bottom 320*b*, and the strip 312 is closely fixed to the bottom 320*b*. Then, similar to the above embodiment, the resilience of the strip 312 and the hooking parts 311 positioned at both ends act on the bottom side of the transportation container 320. Thus, downward force of the heavy article housed in the transportation container 320 to the bottom 320*b* can be suppressed.

As described above, even in the case where the transportation container 320 has no proper part for holding a hook, providing the screw holes in the sides 320*c* makes the metal reinforcement fitting 310 attachable, and the bottom 320*b* can be prevented from being deformed.

(3) Conclusion

As described above, the metal reinforcement fitting 10 including the strip 12 curved vertically upward is attached to the bottom 20*b* so that the upward force can be applied to the bottom 20*b* of the transportation container 20. The upward force of the metal reinforcement fitting 10 can suppress the downward force of a heavy article housed in the transportation container 20. Accordingly, if the metal reinforcement fitting 10 is attached to the bottom 20*b* of the transportation container 20 before the heavy article is housed, the bottom 20*b* is prevented from bulging. Additionally, even if the bottom 20*b* of the transportation container 20 has already bulged, the instability caused by the deformation of the bottom 20*b* can be improved by the attachment of the metal reinforcement fitting 10.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

What is claimed is:

1. A reinforced transportation container that is comprised of a transportation container (20) formed of resin and a metal reinforcement fitting (10) which is attached to a bottom of the transportation container (20), wherein:

the transportation container (20) is formed of resin and in an approximate box shape of which upper side is opened as an opening (20*a*), and the upper side flange (21) is provided on sides of the upper side of the transportation container (20) and a bottom side flange (22) is provided on sides of the bottom side of the transportation container (20), the upper side flange (21) is projecting outward continuously from the opening (20*a*) for a predetermined length, and surrounding the peripheral edge of the opening (20*a*), and the bottom side flange (22) is projecting outward by the same length as that of the upper side flange (21), and surrounding the peripheral edge of the bottom side of the transportation container (20) so that when same kind of transportation containers (20) are stacked, the sides and the bottom (20*b*) lower than the bottom side flange (22) of a upper transportation container (20) are inserted into the opening (20*a*) of a lower transportation container (20), and the upper surface of the upper side flange (21) of the lower transportation container (20) abuts with the lower surface of the bottom side flange (22) of the upper transportation container (20), and the metal reinforcement fitting (10) that is attached from underneath to the bottom of the transportation container (20) is comprised of a pair of hooking parts (11) opposite each other and a strip (12), the strip (12) which is formed so as to be curved vertically upward at the center in a length direction and laid across laterally on the bottom of the transportation container (20), integrally formed with the pair of hooking parts (11), connects the hooking parts (11) facing toward each other, and the length of the strip (12) approximately equals that of the transportation container (20) in the short-side direction, and the hooking parts (11) extending upward in a strip shape along the side of the transportation container (20) from the bottom side, and each having an end (11*a*) that has a hook-shaped cross section so as to be capable of hooking with each of the bottom side flanges (22) when the strip (20) is attached to the bottom surface of the transportation container (20).

2. The reinforced transportation container according to claim 1, wherein the strip (12) is bent or curved in a width direction to be formed as a non-flat plate.

3. The reinforced transportation container according to claim 1, wherein the strip is thermal-treated and formed so as to have resilience.

4. The reinforced transportation container according to claim 1, wherein the plurality of metal reinforcement fittings can be attached to the bottom of the transportation container parallel with each other at a predetermined spacing.

5. The reinforced transportation container according to claim 2, wherein the strip has a ridge extending in a length direction.

6. The reinforced transportation container according to claim 1, wherein the hooking parts (11) each has reinforcing parts (14*a*,14*b*) which have a rib of a crest-shaped cross section and are formed to be pushed out from a projected side to a recessed side of the metal reinforcement fitting (10) so as to cross over a fold of bent parts (13*a*, 13*b*).

* * * * *